United States Patent [19]

Bowyer

[11] 4,432,417

[45] Feb. 21, 1984

[54] CONTROL PRESSURE ACTUATED DOWNHOLE HANGER APPARATUS

[75] Inventor: Michael L. Bowyer, Aberdeen, Scotland

[73] Assignee: Baker International Corporation, Orange, Calif.

[21] Appl. No.: 307,903

[22] Filed: Oct. 2, 1981

[51] Int. Cl.[3] ..... E21B 33/129; E21B 34/10

[52] U.S. Cl. ..... 166/120; 166/129; 166/72; 166/131; 166/322

[58] Field of Search ..... 166/120, 72, 131, 184, 166/123, 125, 181, 182, 321, 322, 373, 374, 375, 382, 129

[56] References Cited

U.S. PATENT DOCUMENTS

| | | | |
|---|---|---|---|
| 2,546,377 | 3/1951 | Turechek | 166/134 |
| 3,265,132 | 8/1966 | Edwards, Jr. | 166/120 |
| 4,289,200 | 9/1981 | Fisher, Jr. | 166/120 |

*Primary Examiner*—James A. Leppink
*Assistant Examiner*—Hoang C. Dang
*Attorney, Agent, or Firm*—Norvell & Associates

[57] ABSTRACT

A hanger and valve assembly which can be employed as a safety valve assembly to close both the production tubing and the tubing-casing annulus in a subterranean well is disclosed. The assembly includes a hydraulically activated, mechanically locked hanger which has slip anchoring members engaging the casing or, exterior conduit for preventing movement in both longitudinal directions. The hanger also has annular packing elements to seal the tubing-casing annulus. An annulus safety valve member employing a longitudinally recessed resilient seal member can be mounted in a landing nipple mounted in the hanger. By recessing the seal it is protected from the turbulent flow through the valve. A second shuttle located in the landing nipple is employed in conjunction with the first annulus safety valve to permit flow in one direction while metering flow in the opposite direction. This assembly is especially useful for permitting the injection of treating fluids through the annulus and production through the tubing or inner conduit. A conventional safety valve is employed to prevent flow though the tubing when control pressure is lost or reduced. Both the valves and the hanger can be activated by control fluid pressure through the same control line. A setting sleeve which can be mounted in the annulus safety valve landing nipple prior to installation of the annulus safety valve can be used to permit the hanger to be set using control fluid pressure.

14 Claims, 22 Drawing Figures

CONTROL PRESSURE ACTUATED DOWNHOLE HANGER APPARATUS

BACKGROUND OF THE INVENTION

1. Field of the Invention

This invention relates to valves used to close the interior of a conduit, such as a tubing string, and the annular area between a tubing string and an exterior casing in a subterranean well.

2. Description of the Prior Art

In subterranean wells, especially offshore wells, it is necessary to provide a means of closing off the tubing string and the annular area between the tubing and the casing to prevent produced fluids from being ejected from the well in case of damage to the well head. In conventional use of safety valves for controlling the flow of fluid in the tubing or in the annulus, these safety valves are mounted in a hanger secured to the outer casing and supporting the tubing extending below the hanger. An example of one single string tubing hanger is shown on pages 760 and 761 of the 1980-81 Composite Catalog of Oil Field Equipment and Services published by World Oil. Some prior art hangers also employ an exterior packoff member for establishing a seal between the hanger and the external casing. For example, one prior art hanger employs a single grip anchoring device in which radially expandable slips hold the hanger secured to the exterior casing and support the weight of the tubing. The packoff member is acted upon by the weight of the tubing and by the inner directional slip system to maintain a compressive load upon the packoff member, thus maintaining a suitable annular seal.

If a single string completion is employed and if it is necessary to inject a treating fluid from the surface while producing through the single string completion, then production must occur in either the tubing or the tubing casing annulus while injection takes place through the other passage. In such a system it is then necessary to employ not only a safety valve to close the single tubing string, but also to use a annulus safety valve to close that alternate passage. Any of a number of safety valves for controlling the flow in the tubing string may be employed in those completions where control in both the tubing and in the annulus are necessary. These tubing safety valves can be either a ball type or flapper type safety valve, and conventionally these valves would be controlled by the injection of fluid through an exterior control line extending to the surface of the well. By pressurizing the valve through the control fluid string the flapper may be opened to permit flow in the tubing. When pressure is removed, either intentionally or by virtue of an accident at the well head, these spring biased ball or flapper valves will close to shut off flow from the tubing. In addition to safety valves for controlling the flow through the tubing string, some means must be provided for controlling the flow from the annulus. Annulus safety valves mounted in the hanger and employing valves for opening and closing a bypass around a hanger packoff member are known in the prior art.

SUMMARY OF THE INVENTION

This invention relates to an improved annular safety valve assembly for use in wells in which treating fluids are injected in the tubing casing annulus and bypass the packoff assembly in a packoff tubing hanger. Produced fluids then flow to the surface through the centrally located tubing string. This invention provides an improved seal apparatus which is especially useful in an annular safety valve which must be repeatedly opened and closed. In this invention this seal is not exposed to the turbulent flow encountered when conventional seals are employed.

This invention provides a shiftable valve member for use in a subterranean well and can be employed as a safety valve for closing the annulus between an interior and exterior conduit. The shiftable valve comprises a longitudinally extending inner valve mandrel which has two sleeve members in surrounding concentric relation. These two sleeve members are longitudinally movable with respect to each other. At least one of the sleeve members is movable relative to the inner valve mandrel. Biasing means such as a spring can be employed between the inner valve mandrel and the movable sleeve member to urge the ends of the first and second sleeve members into abuttment. Movement of at least one of the sleeve members can be accomplished by utilizing a hydraulic actuating mechanism including a pressure chamber. This hydraulic actuating mechanism can be activated by control pressure supplied through a control fluid line extending from the valve to the surface of the well. When the ends of the shiftable valve sleeves are abutting, the sleeves close a longitudinally extending flow passage through the valve. Movement of one of the sleeves relative to the other sleeve opens the flow passage so that fluid can blow in one direction, normally in the downward direction in the tubing casing annulus. A resilient sealing member is provided on the end of the upstream sleeve member and is positioned to engage the abutting end of the opposite sleeve member. In the preferred embodiment of this invention, this seal is recessed in the end of the movable sleeve member so as to minimize exposure of the seal to the tubulent flow of fluids traveling in the first direction.

In the preferred embodiment of this invention this shiftable valve member is employed in an annulus safety valve member which can be mounted in a nipple adapted to be mounted in the production tubing. This nipple can employ a shuttle valve member which is in turn spring loaded and is positioned to permit flow in the same direction in which flow is permitted in the valve member. In the preferred embodiment of this invention fluid injected into the annulus would overcome the spring bias normally urging the shuttle valve member into the closed position. This shuttle valve member could also include a separate bypass port which meters flow through the shuttle valve member in the opposite or upward direction.

DESCRIPTION OF THE PREFERRED EMBODIMENTS

Figure 1A:
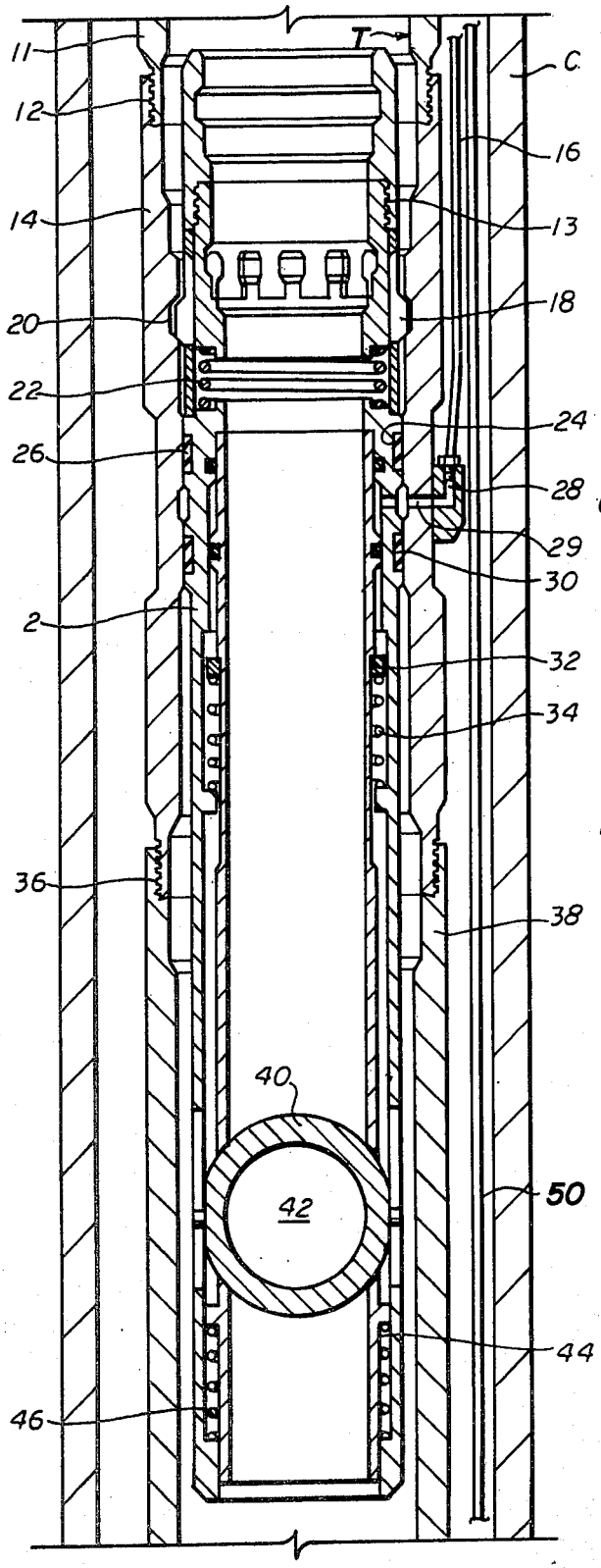
FIG. 1 comprises a series of four continuations, FIGS. 1A through 1D, depicting a safety valve system comprising a tubing safety valve, an annulus safety valve, and a hanger.
Figure 1B:
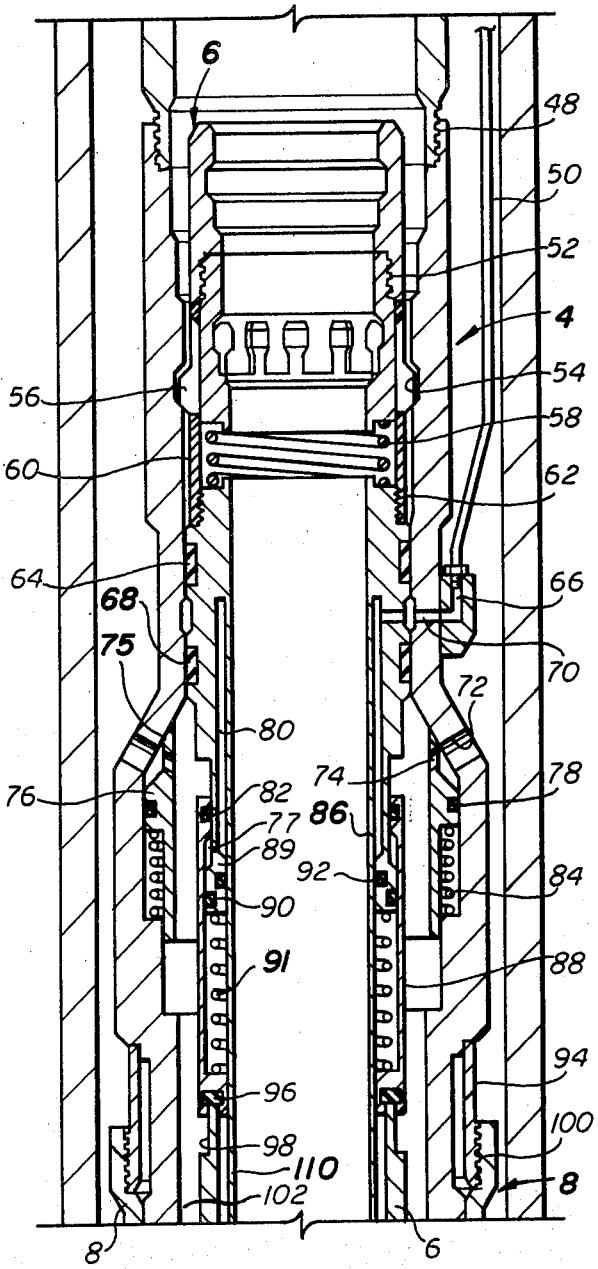
Figure 1C:
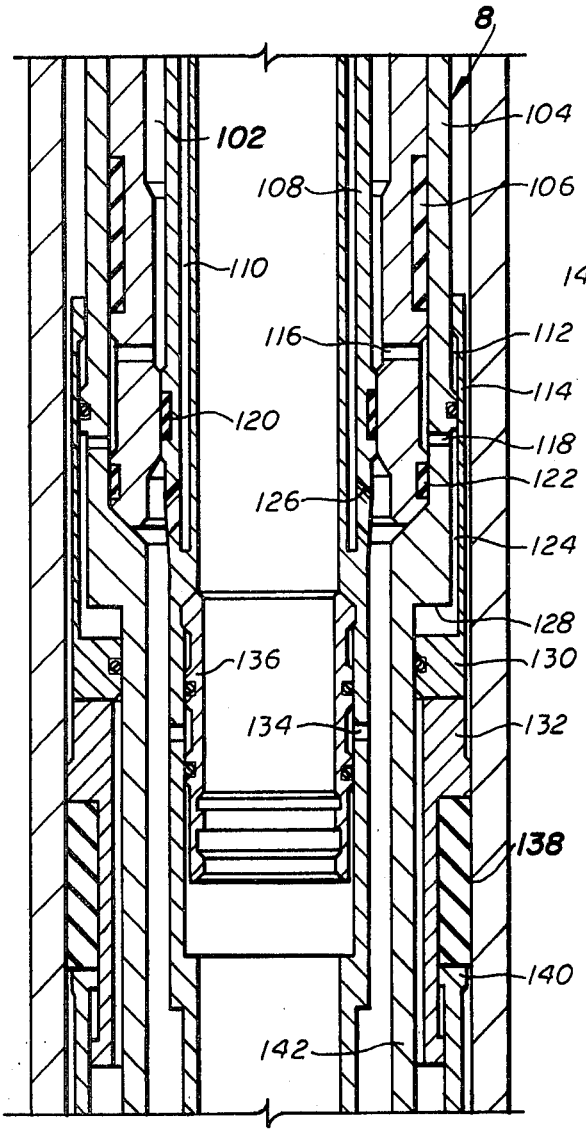
Figure 1D:
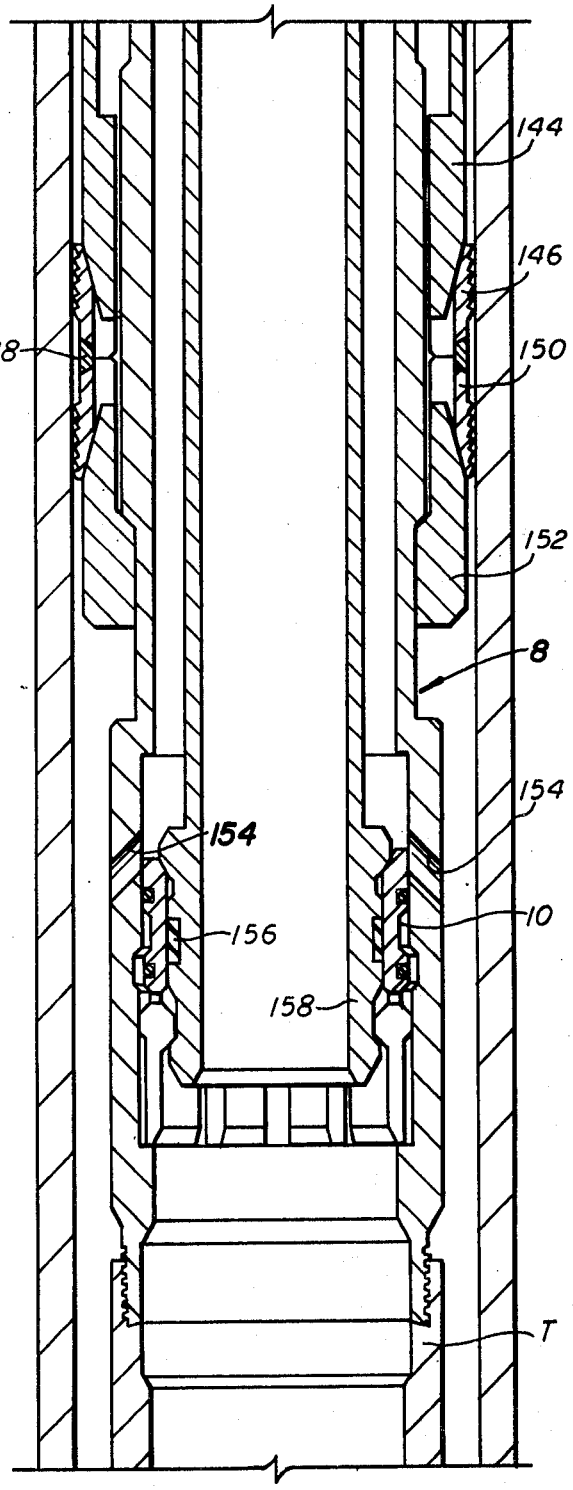
Figure 2:
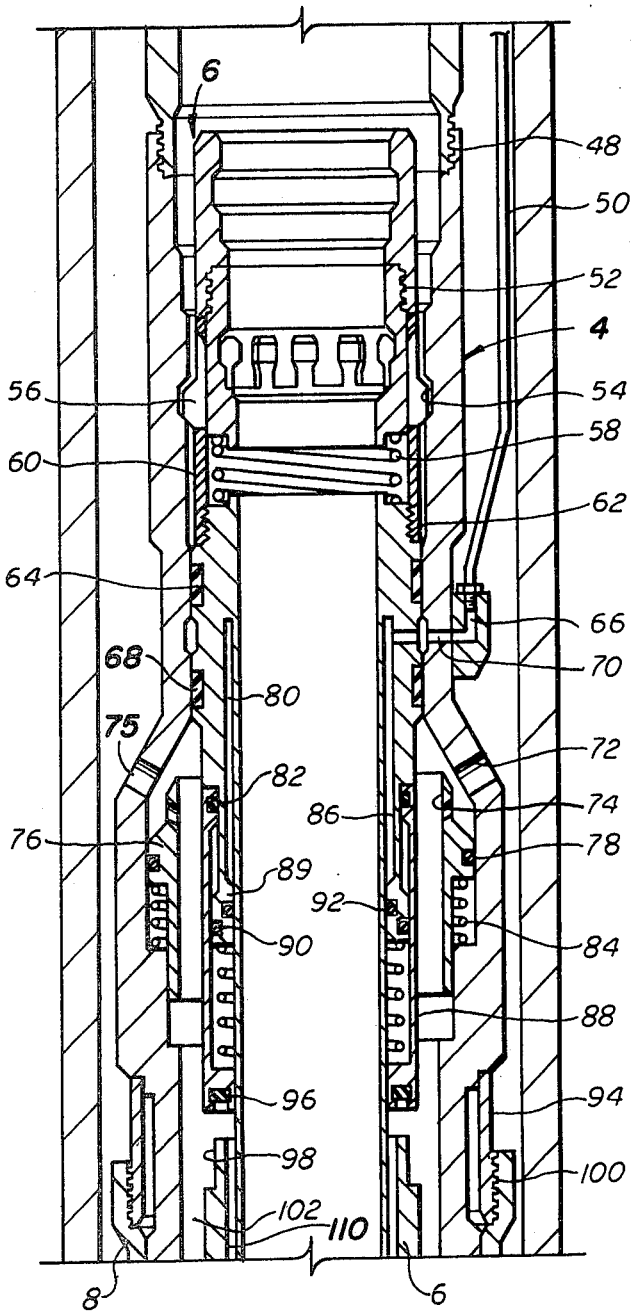
FIG. 2 is a view similar to FIG. 1B, showing the annulus safety valve in the open position.
Figure 3A:
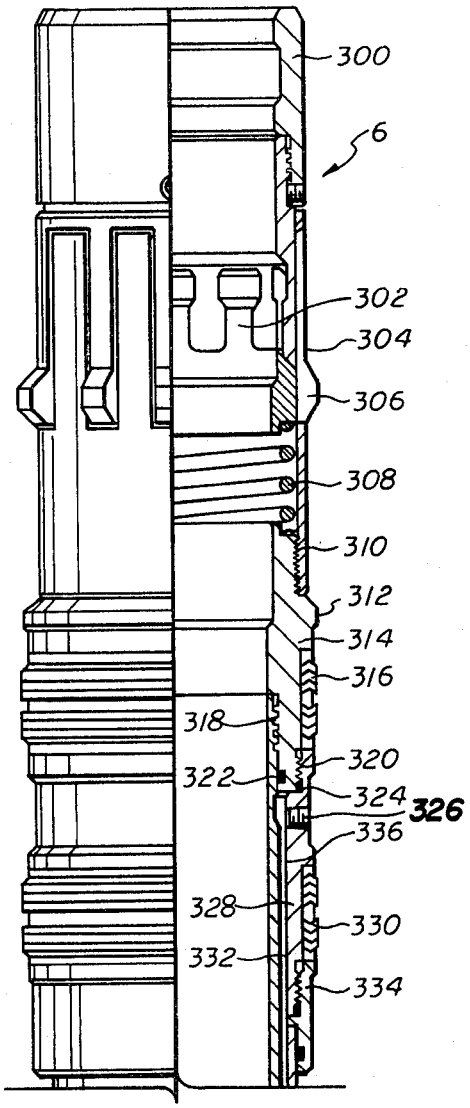
FIG. 3 comprises a series of four continuations, FIGS. 3A through 3D, showing the detailed construction of the annulus safety valve.
Figure 3B:
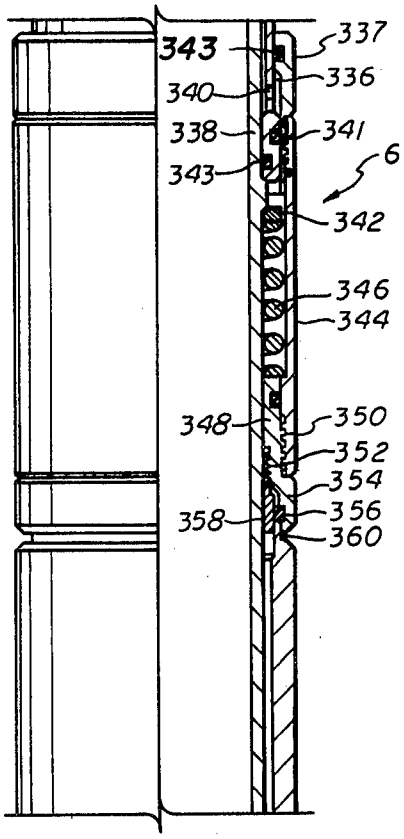
Figure 3C:
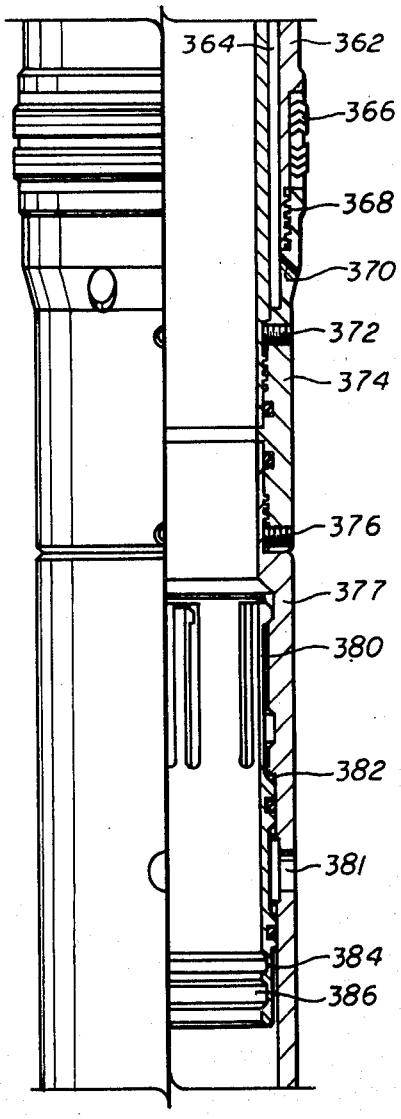
Figure 3D:
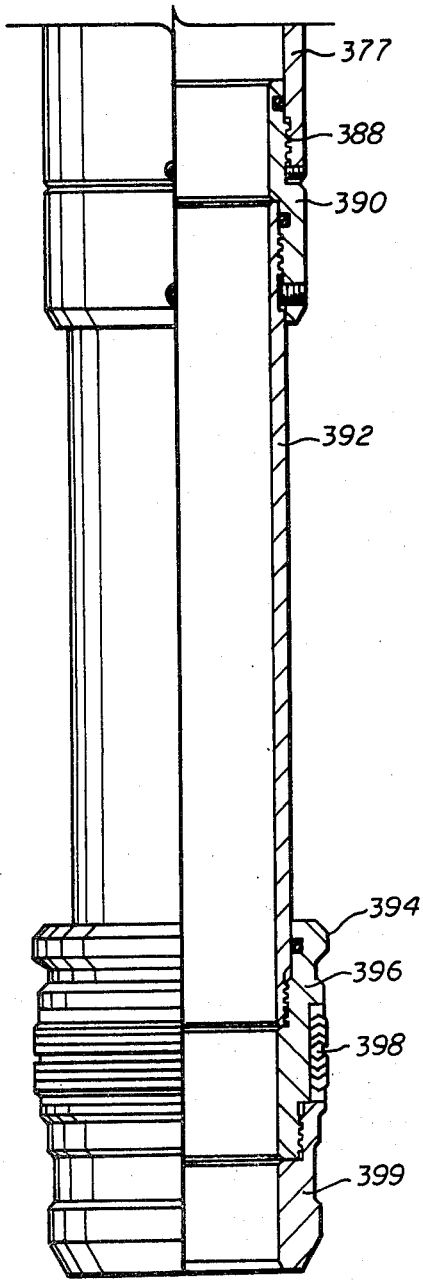
Figure 4A:
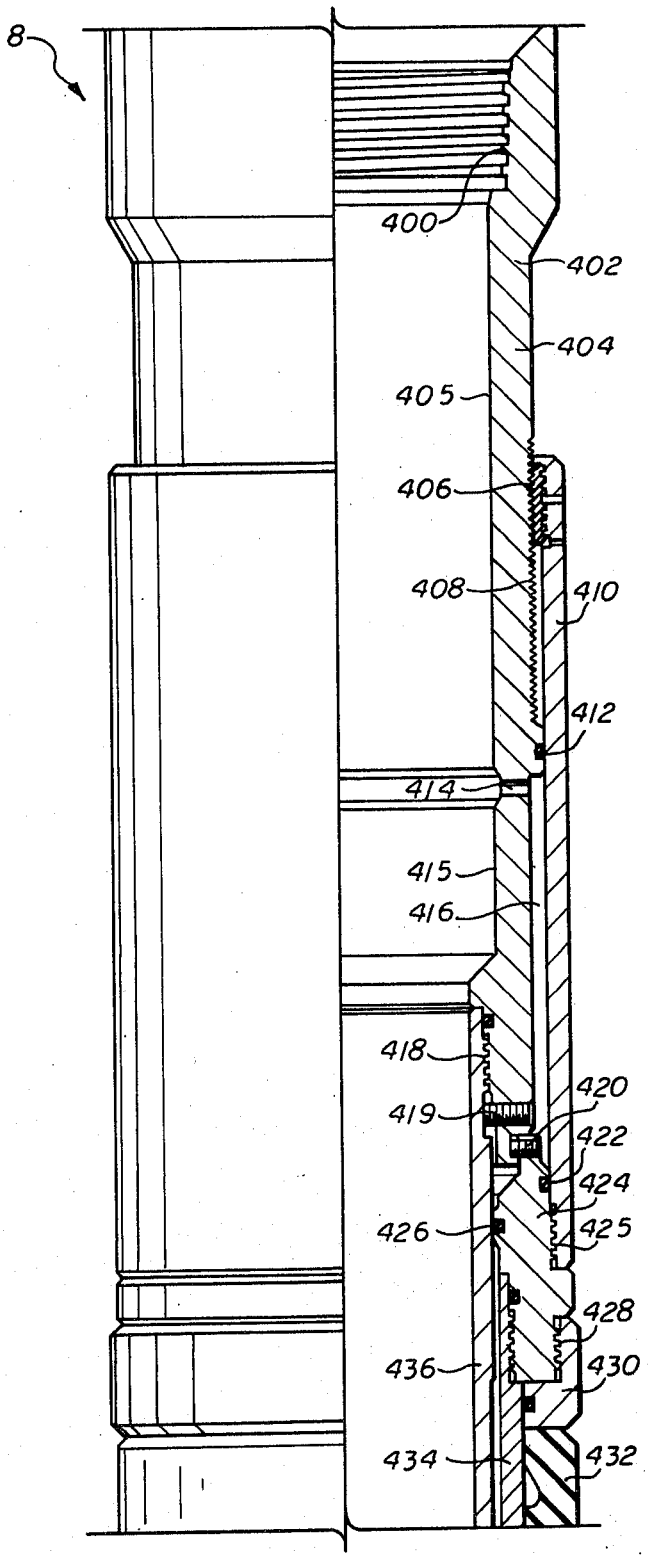
FIG. 4 comprises a series of four continuations, FIGS. 4A through 4D, showing a hydraulically set dual-grip packoff tubing hanger.
Figure 4B:
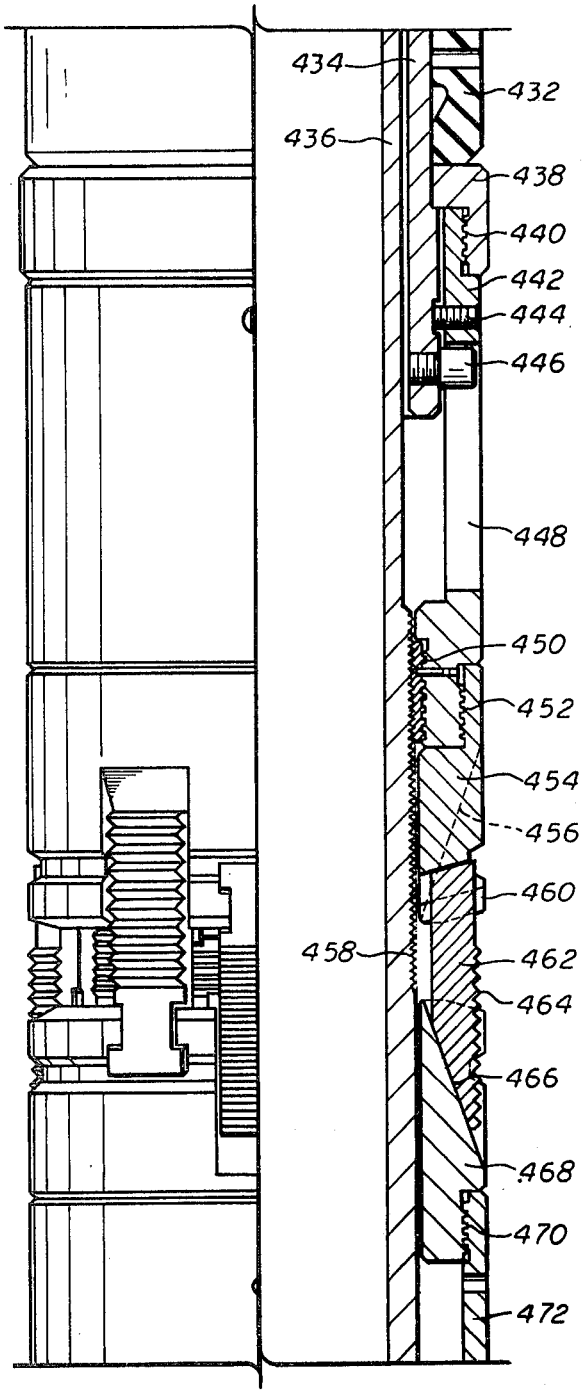
Figure 4C:
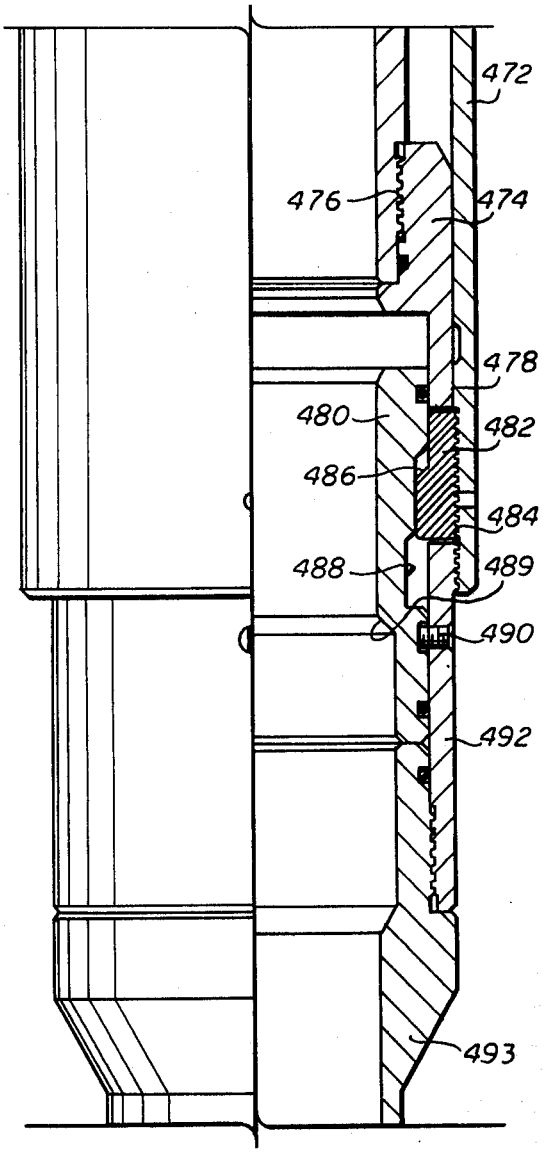
Figure 4D:
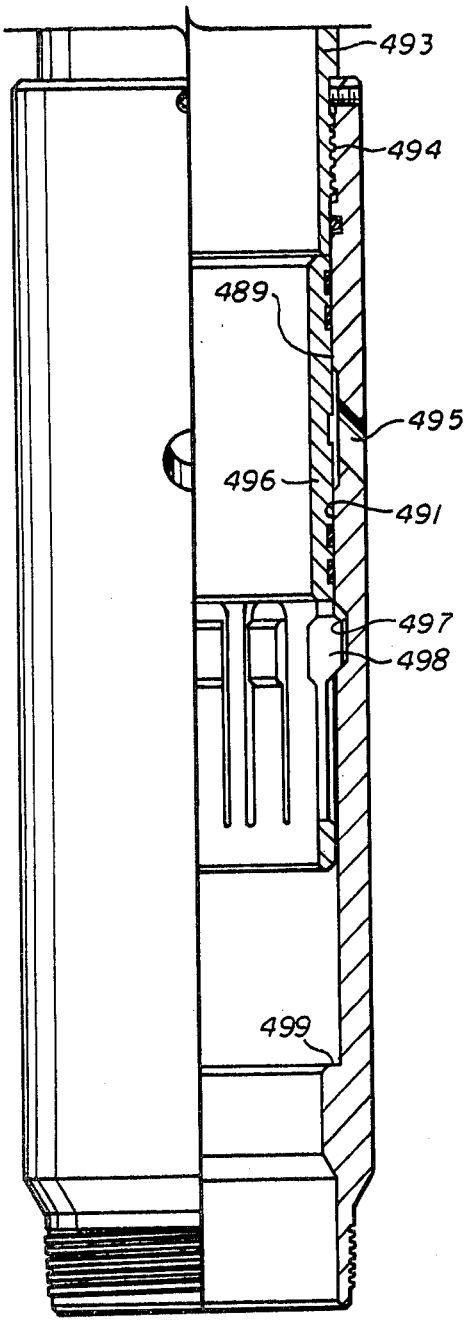

The single string packoff tubing hanger and safety valve system, shown in FIGS. 1A through 1D, comprises a system for supporting the production tubing extending below the assembly and means for shutting off the flow in both the tubing and the annulus between the production tubing T and the casing C of a subterranean well. Although FIGS. 1A through 1D depict this assembly in significant detail, this view is nevertheless somewhat schematic in nature. The schematic nature of FIG. 1 is necessitated because of the undue complexity which would result if the detailed construction of the individual components were shown in FIG. 1. FIG. 2 and FIG. 7 are similarly schematic in nature. The remaining figures show the detailed construction of the components of this hanger-safety valve assembly. Where there is a difference between the structure depicted in the schematic figures and that depicted in the views showing the individual components, the true structure of the preferred embodiment of this invention will be as shown by the detailed views of the individual components. It should be understood, however, that these differences in detail in no way affect the invention as shown and described herein. Any differences between the construction shown in FIGS. 2 through 6, and in FIG. 8, from that shown in FIGS. 1, 2, and 7, are merely differences in detail and do not relate to the invention as embodied herein.

The preferred embodiment of this invention, as shown in FIG. 1, comprises five principal components. The first component of the preferred embodiment of the assembled tubing hanger safety system is a conventional safety valve 2 mounted in the tubing T. A conventional safety valve which can be used in this invention is described at pages 774 and 775 of the 1980–81 edition of the *Composite Catalog of Oil Field Equipment & Services* published by World Oil. Tubing safety valve 2 is mounted on the interior of a nipple which is incorporated into the tubing string. Safety valve 2 is positioned above another nipple also incorporated into the tubing string. Annulus safety valve landing nipple 4 is incorporated into the tubing string and also engages a tubing hanger 8 which supports that portion of the tubing string T below the hanger safety valve assembly. Annulus safety valve 6 is mounted along the interior of annulus safety valve landing nipple 4 and extends along substantially the entire length of both landing nipple 4 and hanger 8. Tubing hanger 8 employs a packing element 138 and a pair of slips 146 and 150 for engaging the outer casing and isolating that portion of the tubing-casing annulus thereabove from the production zone in the annulus extending therebelow. A flow port 154 is located adjacent the lower end of tubing hanger 8, and a sliding sleeve 10, shown in the open position in FIG. 1 and in the closed position in FIG. 7, is mounted on hanger 8 to selectively open and close port 154.

Before discussing the operation of the tubing hanger, safety valves and the retrieving and equalizing tools used in conjunction therewith, it will be necessary to describe in detail the structure of the individual components which may be assembled as shown in FIG. 1.

The detailed construction of dual-grip packoff tubing hanger 8 is shown in FIG. 4. This tubing hanger engages the casing of the subterranean well and supports that portion of the production tubing T extending therebelow. At the upper end of tubing hanger 8 is an upper body member 404 which has left-hand square threads 400 extending around the interior of an upset or enlarged end 402. These left-hand square threads 402 are for engaging a cooperating latch member incorporated into the tubing string extending above hanger 8. Upper body member 404 is positioned above packing element 432 and is located on the interior of an axially movable piston 410. Piston 410 comprises a cylindrical member in surrounding relationship to upper body 404 which engages upper body 404 through a body lock ring 406. Body lock ring 406 employs threaded elements on the interior and the exterior of this cylindrical member. The threaded elements on the interior of body lock ring 406 are adapted to ratchet relative to threaded elements 408 located on the exterior of upper body member 404. The orientation of the threaded elements on body lock ring 406 permit the body lock ring to move only axially down relative to upper body 404 as its wickers ratchet along the threaded elements 408. Body lock ring 406 does not, however, move relative to piston 410. Movement of piston 410 will, therefore, be irreversible and body lock ring 406 will hold piston 410 in an extended position after any expansion.

On the exterior of upper body member 404 is an enlarged shoulder containing an O-ring seal 412 which establishes sealing contact with both upper body 404 and the interior surface of sliding piston 410. This seal member 412 is located immediately above a port 414 which extends radially through upper body member 404. Port 414 extends from the interior of tubing 2 to a longitudinally extending pressure chamber 416 located between upper body member 404 and sliding piston 410. Pressure in chamber 416 provides the means for moving piston 410. Chamber 416 is bounded by piston 410, upper body 404, head 424 and seals 412, 422 and 426. On the interior of upper body member 404 the surfaces immediately above and below port 414 comprise seal bores 405 and 415. Seal bores 405 and 415 are both recessed from the inner surface of hanger 8 along the substantial portion of its length. Both sliding piston 410 and upper body member 404 are attached to a piston head element 424 located at the lower end of each of the two upper members. Piston sleeve 410 engages head 424 by means of a threaded connection 425 with an O-ring seal 422 extending therebetween. Upper body member 404 engages head 424 by means of a shear screw 420 extending through head 424 into an appropriate and cooperating recess on upper body member 404. Upper body member 404 is also attached at its lower end to inner mandrel 436 by means of a threaded connection 418. A set screw 419 serves to hold the connection between upper body member 404 and inner mandrel 436 in place. O-ring seal 426 extends between head 424 and inner mandrel 436 and the piston head element 424 is axially movable relative to inner mandrel 436. Shear screw 420 does, however, hold piston head 424 and sliding piston sleeve 410 fixed relative to inner mandrel 404, at least until sufficient axial force is applied to sever shear screw 420.

Piston head element 424 is attached at its lower end to a seal retainer ring 430 by means of threaded connections 428. Seal retainer ring 430 is positioned in partial surrounding relationship to piston head element 424 and at its lower end retainer 430 engages packing element 432. Piston head element 424 is also threadably engaged at its lower end to packing element mandrel 434 which extends beneath packing element 432. Packing element mandrel 434 is positioned between packing element 432 and inner mandrel 436 which extends over a substantial portion of the length of hanger 8. A second or lower packing element retainer ring 438 also abuts packing element 432 and is positioned on the outer surface of packing element mandrel 434. Lower packing element retainer 438 does not engage packing element mandrel 434 but it is positioned in abutting relationship to an upwardly facing shoulder on packing element mandrel 434. Packing element 432 which, in the preferred embodiment, contains a plurality of cavities therein which are used to provide uniform expansion of the packing element 432, is positioned between upper and lower packing element retainers 430 in such a manner that the packing element will be radially expanded as the retainers move relatively towards each other. Lower packing element retainer 438 has a downwardly extending portion which partially surrounds a torque transmitting element 442. Retainer 438 engages torque transmitting element 442 by means of a threaded connection 440. Torque transmitting element 442 in turn engages packing element mandrel 434 by means of a set screw 444. Torque transmitting element 442 has an axially extending slot 448 which provides adequate clearance for a torque pin 446. Torque pin 446 threadably engages packing element mandrel 434 and since the head of torque end 446 extends into axially extending slot 448 any torque transmitted through packing element mandrel 434 will in turn be transmitted to the lower portion of the hanger.

At its lower end, torque transmitting element 442 is threadably engaged by means of a connection 452 with an upper slip expander 454. At its inner lower end, torque transmitting element 442 engages the outer wickers on a ratcheting body lock ring 450. Body lock ring in turn engages threaded elements 458 on inner mandrel 436. In the position shown in FIG. 4, body lock ring 450 is adjacent to the upper extent of its travel along threaded elements 458. The wicker elements on the interior of body lock ring 450 have a height which is substantially less than the height of the threaded wickers on the exterior of body lock ring 450. The body lock ring can therefore ratchet along threaded elements 458 and can move relative to inner mandrel 436. The body lock ring 450 is, however, fixed relative to torque transmitting element 442. Ratcheting movement of body lock ring 450 is permitted because the cylindrical body lock ring does contain a slit which allows it to flex radially outward.

The upper expander housing which is positioned below body lock ring 450 engages a radially expandable slip element 462 by means of a T-shaped connection 460 at the upper end of slip 462. The slip 462 has an inclined internal camming surface adjacent its lower end which, as shown in FIG. 4, is positioned in contact with an upwardly facing inclines or wedged surface 466 on lower expander member 468. As upper expander housing 456 moves relative to lower expander member 468, slip 462 will move radially outward along wedge surface 466 and along the T-shaped slip ring connection 460. The quarter section shown in FIG. 4 does depict one slip element 462 in cross-section, but as can be seen in the exterior portion of this view there are a plurality of slip elements extending around this hanger. This plurality of slip elements form a dual-grip system in which half of the slip elements engage upwardly facing inclined surfaces 466 and the other half engage downwardly facing slip elements as indicated by surface 456. This dual-grip slip system then retains the hanger against both upward and downward forces in movement.

Both upper expander element 456 and lower expander element 468 may initially move longitudinally or axially relative to inner mandrel 436. Lower expander element 468 is attached through a conventional threaded connection 470 to an outer retaining cylindrical sleeve 472. Retaining sleeve 472 extends generally concentrically relative to inner mandrel 436. Retaining sleeve 472 encompasses an inner retaining sub 474. Sleeve 472 is movable relative to and along the outer surface of inner retaining sub 474. Inner retaining sub 474 is attached to the lower end of inner mandrel 436 by means of a conventional threaded connection 476. Outer cylindrical sleeve 472 is therefore free to move axially relative to inner mandrel 436 and to inner retaining sub 474. Retaining sleeve 472 has a plurality of threaded elements 478 located along its inner surface at the lower end thereof. A portion of retaining sleeve 472 extends along part of the threaded elements 478 and inner retaining sub 474. Threaded elements 478 do, however, engage the threaded elements 484 on the outer surface of a plurality of circumferentially spaced segments 482. In the position shown in FIG. 4, segments 482 are held in a radially expanded position in engagement with threaded elements 478 by means of a shiftable retaining or releasing member 480. Both segments 482 and shiftable retaining member 480 have stepped surfaces 486 and 488, respectively, which hold segment 482 in the radially expanded position when the shiftable member is in the position shown in FIG. 4. Segments 482 extend through an opening in inner retaining sub 474 preventing relative longitudinal movement therebetween. Shiftable member 480 is in turn shear-pinned to the lower part of 492 of sub 474 by means of the shear screw 490. Prior to the point at which screw 490 is sheared, shiftable member 480 is fixed to retaining sub 474. Thereafter shiftable member 480 may move upward until its upper surface abuts a corresponding lower surface on retaining sub 474. Upward movement of member 480 may be accomplished by engagement of an upwardly facing shoulder on a suitable retrieving tool with the downwardly facing shoulder 489 on member 480. Upward movement of shiftable member 480 permits segments 482 to collapse inwardly out of engagement with threaded elements 478 on retaining sleeve 472.

At the lower portion of inner retaining sub 474 is a cross-over sub 493 which in turn engages a lower port sub 494. Lower port sub has a flow port 495 extending radially therethrough. A locking recess 497 is positioned beneath flow port 495. A sliding sleeve 496 is positioned on the interior of lower port sub 494 and in the position shown in FIG. 4, sleeve 496 seals flow port 495 at seal bores 489 and 491, flanking port 495. Sleeve 496 is releasably held in sealing position by means of a radially extending collet 498 which engages locking recess 497. Movement of sleeve 496 downward until lowermost face of collet 498 engages a surface 499 on sub 494 will open port 495. Hanger 8 shown in FIG. 4 thus provides a packoff member, a dual-grip anchoring slip assembly, release means, and a sealable radially extending flow port at its lower end.

Figure 6A:
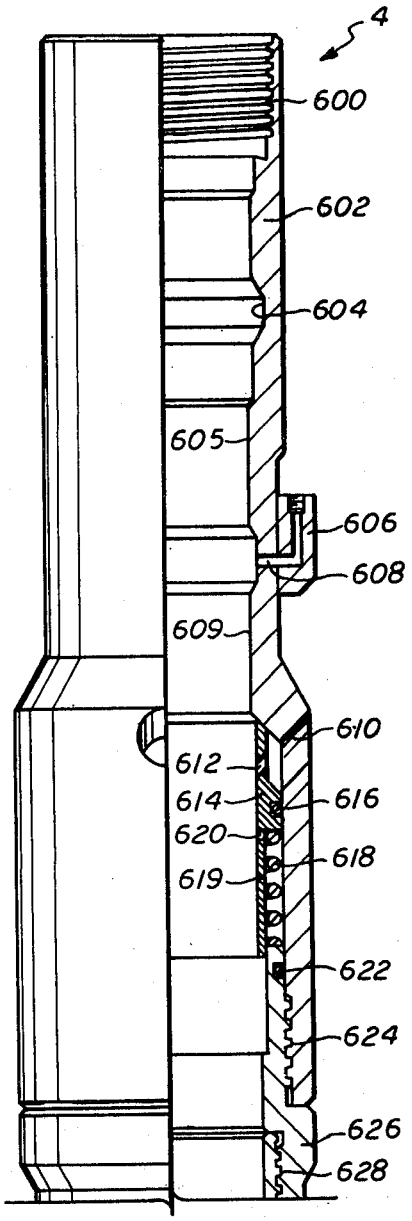
FIG. 6 comprises continuations, FIGS. 6A and 6B, illustrating the annulus safety valve landing nipple subassembly with pilot check valve.
Figure 6B:
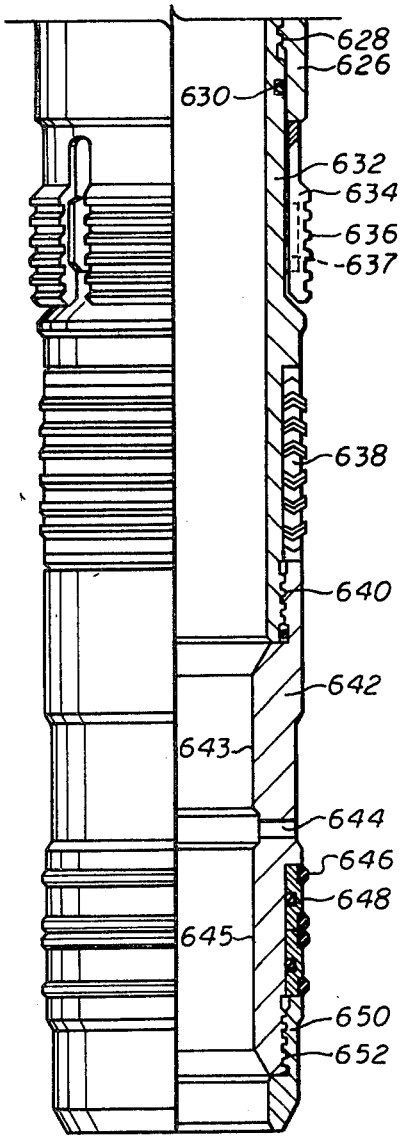
Figure 7A:
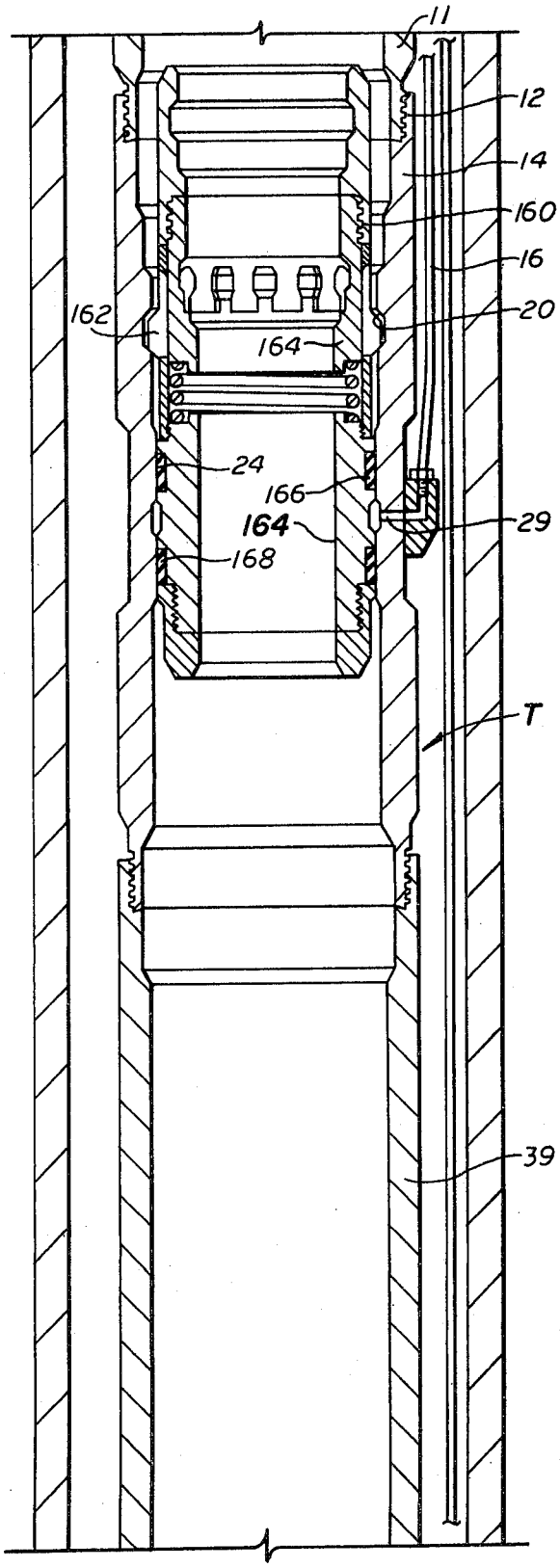
FIG. 7 comprises a series of four continuations, FIGS. 7A through 7D, illustrating the separation sleeve used to set the packoff tubing hanger shown in FIG. 4.
Figure 7B:
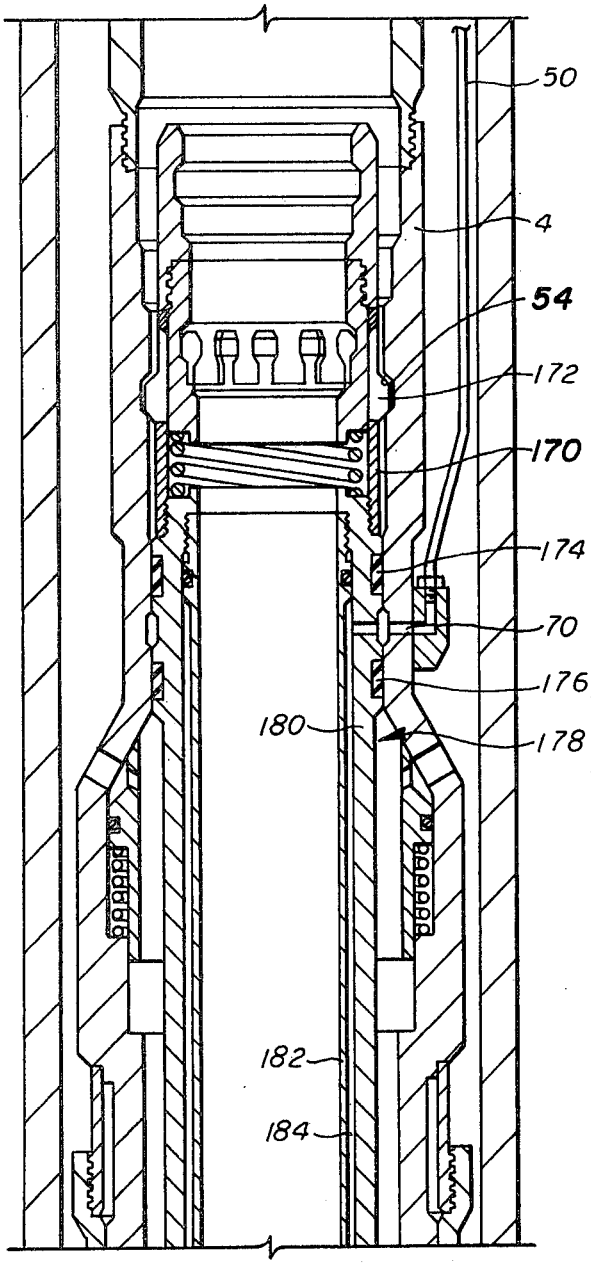
Figure 7C:
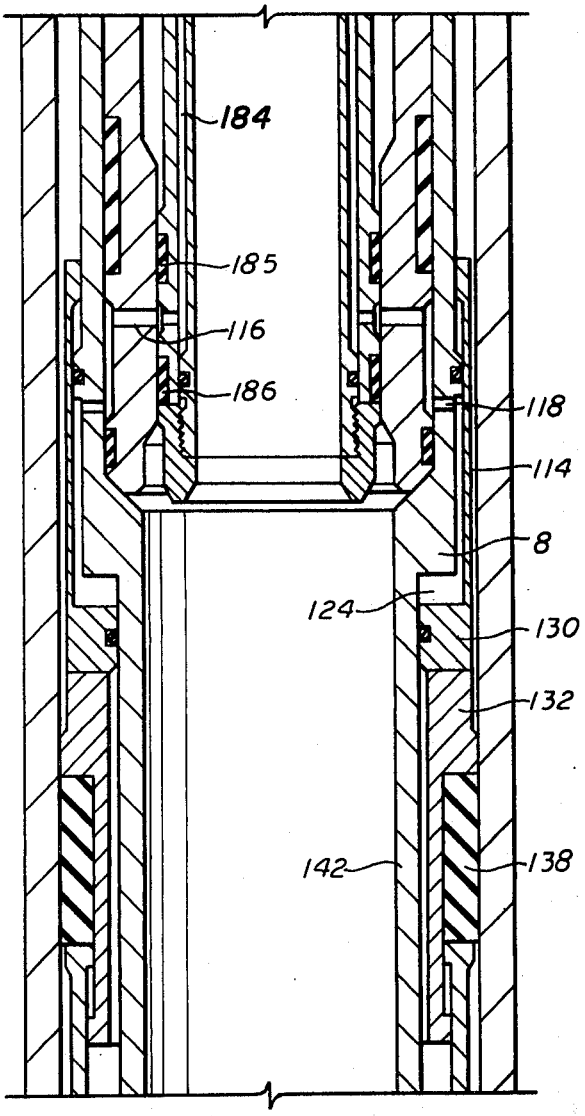
Figure 7D:
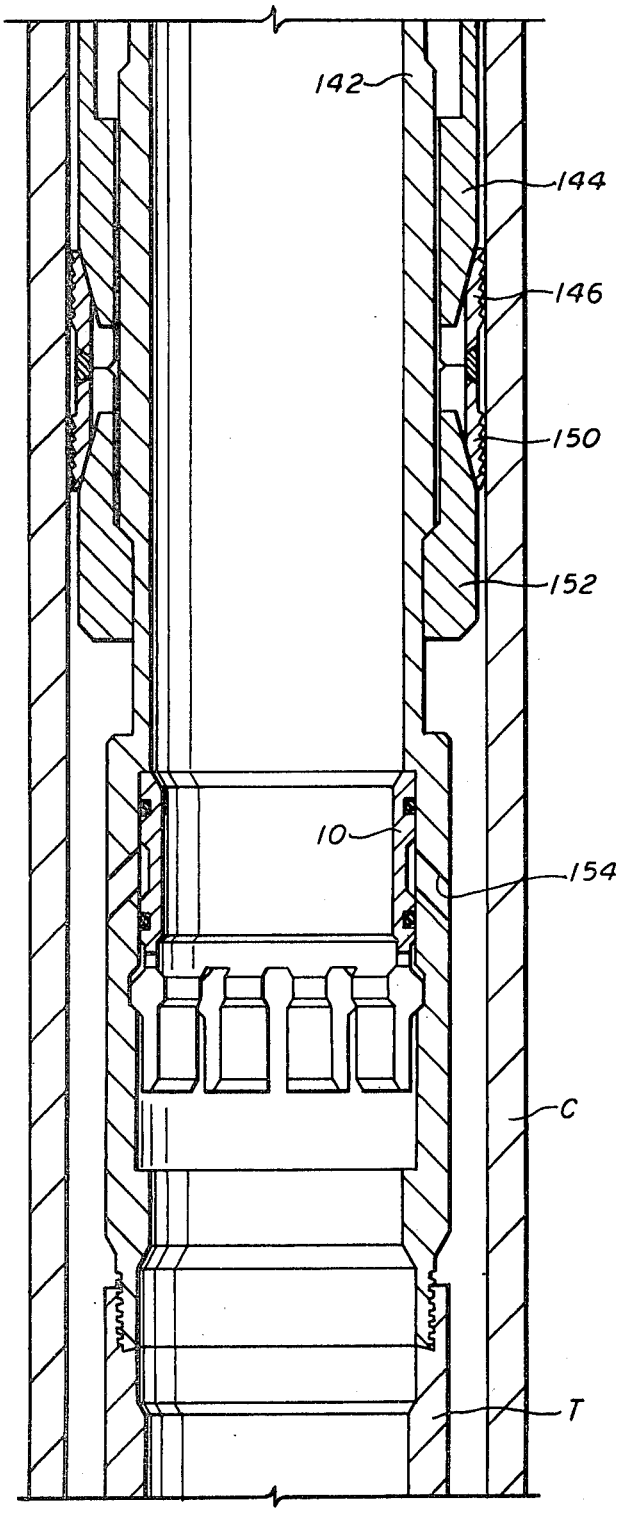

After hanger 8 has been positioned in engagement with the outer casing C, with the production tubing T extending therebelow supported by hanger 8, an annulus safety valve landing nipple may be positioned in engagement with hanger 8. As seen in FIG. 1, annulus safety valve landing nipple 4 would normally be incorporated as an integral member of the production tubing extending above the hanger 8. Landing nipple 4, shown in more detail in FIG. 6, is incorporated into the tubing string by means of threads 600 located at the upper end of nipple upper body member 602. Interior locking groove recess 604 is located on the inner surface of upper body member 602 beneath threads 600. A polished seal bore surface 605 extends therebelow above a radially extending port 608. Radially extending port 608 communicates with a port in control line connection 606 located on the exterior of the nipple 4. A seal bore surface 609, similar to 605, is positioned below port 608. Immediately below seal bore surface 609, both the internal diameter and the external diameter of upper body 602 increase. The lower portion of upper body 602 has an outer diameter generally equivalent to the outer diameter of control line connection 606 located thereabove. A flow port 610 extends through upper body section 602 at the upper end of this increased diameter section. A conventional threaded connection 624 is located at the lower end of upper body section 602 and cross-over member 626 engages upper body section 602 by means of this threaded connection. Cross-over member 626 also has an O-ring seal extending between the lower portion of the upper body member 602 and cross-over member 626.

A slidable shuttle valve 614 is positioned beneath the lower section of upper body segment 602 and a seal is established by O-ring 616 between the shuttle valve and the nipple body. Shuttle valve 614 is spring loaded and as shown in FIG. 6 spring 618 urges slidable valve 614 upward to establish a face-to-face metal seal between the upper end of valve 614 and the inner surface of body 602. Shuttle valve 614 does, however, have a bypass port 612 extending radially therethrough to permit passage of fluid through bypass port 612 and flow port 610. A second port 620 also extends through the spring retaining sleeve portion of shuttle valve 614. This spring retaining sleeve portion 619 is spaced radially inward from the lower surface of cross-over member 626 and shuttle valve 614 may move longitudinally relative to port 610 and cross-over member 626. Cross-over member 626 is attached to mandrel 632 by means of a conventional threaded connection 628 with an O-ring seal 630 extending between these two members. Immediately beneath cross-over member 626 is a cylindrical latch member 634 surrounding mandrel 632. Latch 634 has a plurality of threads 636 located along its exterior. Threads 636 are located in the collet portion of latch 634 and these threads are adapted to engage cooperating threads 400 on the top of hanger 8. Latch 634 is held in position relative to mandrel 632 by means of keys on the exterior of mandrel 632 which engages a cooperating slot on the rear of latch 634. A conventional stack of chevron sealing elements 638 is positioned along the exterior of mandrel 632 adjacent its lower end. Mandrel 632 is attached to lower sub 642 by means of conventional threaded connections 640 and an O ring seal (unnumbered). Lower sub 642 has first and second polished seal bore surfaces 643 and 645 along its interior, both of which flank a port 644 which extends radially through lower sub 642. Along the exterior of lower sub 642 below port 644 are a pair of sealing elements, each of which comprise a seal ring 648 and at least one molded elastomeric sealing element 646. These sealing elements are held in position on the exterior of lower sub 642 by means of a seal retainer 650 which engages sub 642 by means of threaded connection 652.

Landing nipple 4 may be positioned on the interior of hanger 8, as shown in FIG. 1, in order to properly position an annulus safety valve on the interior of tubing string 2. The detailed construction of annulus safety valve 6 is shown in FIG. 3. Annulus safety valve 6 is again attached to a conventional lock member 300 at its upper end. This lock member comprises a slidable inner collet 302 and an outer collet 304 which encompasses a radially extending dog or lug member 306. A spring 308 maintains the inner slidable collet 302 in a position in which the outer dog or lug 306 is in its radially expanded position. Lock 300 is attached to the upper end of annulus safety valve 6 by means of a conventional threaded connection 310. Immediately adjacent the upper end of safety valve 6 is a radially outwardly extending ring or shoulder member 312 which is commonly referred to as a no-go shoulder. Safety valve 6 in turn has a pair of conventional seal stacks 316 and 330, each stack containing a plurality of conventional chevron-shaped sealing members. The upper seal stack 316 is held in place along the outer surface of an upper seal retainer 314 which also contains the no-go shoulder and threaded connections 318 and 320 along the inner and outer surfaces, respectively. O-ring seals 322 and 324 provide sealing integrity along the inner and outer surfaces of seal retainer 314 at its lower end. Seal retainer 314 is attached along its inner end to valve mandrel 338. The upper seal retainer 314 is attached to an intermediate seal retainer 328 by means of threaded connection 320. Retainer 328 positions chevron stack 330 along its exterior surface. Between seal stacks 316 and 330 is a port 326 which extends radially through intermediate retainer 328. Port 326 merges with a longitudinally or axially extending port 332 which extends between valve mandrel 338 and intermediate seal retainer 328. Seal elements 330 are held in position at their lower end by means of lower seal retainer 334 on the exterior of intermediate seal retainer 328. Longitudinal channel 332 communicates through port 340 with a pressure chamber 336 which is located between the lower portion of intermediate seal retainer 328 and a cap member 337. This pressure chamber 336 is sealed by means of seals 335, 341, and 343. Cap member 337 is connected to a sliding piston sleeve 344. This piston sleeve extends downward past intermediate retainer 328 and is concentric with respect to valve mandrel 338. A spring member 346 is located between piston sleeve 344 and valve mandrel 338. Spring 346 engages a washer 342 at its upper end which in turn engages valve mandrel 338. At the lower end of spring 346 it engages a seal housing 348 which is in turn attached to piston sleeve 344. Seal housing 348 has an annular recess in its lower end which contains an elastomeric sealing element 356. Sealing element 356 is contained between an outer lip on seal housing 348 and an interior seal retainer 358 attached to seal housing 348. The seal housing 348, sealing element 356, and retainer 358 are all movable in combination with outer piston element 344. Pressurization of chamber 336 will cause outer sleeve piston 344 to move relatively up, thus moving sealing element 356 up relative to valve mandrel 338. Immediately below seal housing 348 and also in surrounding concentric relationship to valve mandrel 338 is a cylindrical seal ring or sleeve 362 which is spaced from valve mandrel 338 to provide a longitudinally extending flow passage 364 therebetween. Seal ring or sleeve 362 has a longitudinally extending nose or projection at its upper end, which in the configuraion of FIG. 3 engages the seal element 356 to prevent flow from longitudinal passage 364 to the exterior of the valve. Additionally, a conventional sealing stack 366 containing a plurality of chevron-shaped sealing elements is located on the exterior of seal ring 362 adjacent its lower end. Seal ring 362 is threadably engaged with a bypass sub 374 at its lower end by means of connection 368. An outwardly extending flow port 370 is located in bypass sub 374 below seal stack 366. Flow port 370 communicates with longitudinal flow passage 364. Immediately beneath bypass sub 374 is and equalizing housing 378 which is attached to bypass sub 374 by means of a threaded connection and a set screw 376. Equalizing housing 337 has a radially extending port 381 intermediate its ends and provides appropriate recesses for a sliding equalizing sleeve 382 to be located along the interior thereof. Equalizing sleeve 382 comprises an upper collet 380 and O-ring seals in contact with seal bores on opposite sides of port 381. Equalizing sleeve 382 also has a pair of locking grooves 384 and 386 which define a distinct profile for engagement with a tool which is effective to move equalizing sleeve 382 downward to open port 381 to the interior of the tubing. Equalizing housing 378 is in turn attached to a crossover sub 390 to which a lower mandrel 392 is in turn attached. At the lower end of mandrel 392 is a lower packing sub 396 which has an outwardly extending lower no-go shoulder 394. Shoulder 394 has a smaller outer diameter than upper no-go shoulder 312 and upper sealing units 316, 330 and 366. Chevron sealing stack 398 is located on the outer surface of lower packing sub 396 immediately above a lower seal retainer 399.

OPERATION

In addition to the landing nipple 4, the annulus safety valve 6, and the hanger 8, the safety valve assembly shown in FIG. 1 also consists of a tubing safety valve 2. As previously mentioned, this tubing safety valve is of conventional construction. The orientation of the tubing safety valve 2, the landing nipple 4, the annulus safety valve 6, and the hanger 8, is clearly depicted in the schematic view of FIG. 1. The numeral references utilized in conjunction with the descriptions of the various components have not been used with reference to the assembled configuration in FIG. 1. As shown in FIG. 1, tubing safety valve 2 is positioned within production tubing T above hanger 8 by means of nipple 14 incorporated into the tubing string extending above the hanger. This nipple is attached to an upper flow coupling 11 by means of a threaded connection 12. A control line 16 extends in the annulus between the tubing and the casing to a control line connection 28 located on the exterior of nipple 14. Tubing safety valve 2 is attached to the interior of nipple 14 by means of a lock member 13 which has an outwardly extending collet or dog 18 which engages a locking groove 20 on the interior of nipple 14. Seals 26 and 30 on valve 2 engage seal bores above and below a control line port 29 extending through the nipple 14. Control fluid transmitted through port 29 acts in a conventional manner to actuate a ball valve eleent 40 containing a central flow passage 42. In the embodiment of FIG. 1, the ball valve element 42 is positioned with flow passage 42 extending transverse to the production tubing T. In this orientation, tubing valve 2 closes the central tubing flow passage. Injection of fluid through control line 16, however, will open this valve by rotating ball valve element 40 about its axis to align flow passage 42 with the tubing.

Tubing safety valve 2 is located above the annulus safety valve 6 and landing nipple 4 on which annulus valve 6 is mounted. In order to provide proper spacing between tubing valve 2 and annulus safety valve 6 a flow coupling 38 attached by means of threaded connection 36 at its upper end to nipple 14 and by threaded connection 48 at its lower end to annulus landing nipple 4 is used. Landing nipple 4 is attached to that portion of the production tubing extending above the hanger, but it also engages the upper end of hanger 8. The primary function of landing nipple 4 is to provide a means of attaching annulus safety valve 6 at its appropriate location in the tubing string. Annulus safety valve 6 is attached to nipple 4 by means of a conventional lock member 60 which, as is the case with the lock supporting the safety valve controlling tubing flow, engages an appropriate recess 54 in landing nipple 4 by means of a radially outwardly extending dog or lug 56. Lock 60 is attached to annulus safety valve 6 by means of a threaded connection 62 located immediately above an elastomeric seal 64 on the annulus safety valve. Annulus safety valve 6 utilizes two sealing elements 64 and 68 at its upper end, each seal engaging a polished seal bore on the interior of landing nipple 4. A radially extending port 70 extends from control line connection 66 on the exterior of nipple 4 through nipple 4 and communicates with an axially extending flow passage 80 in the annulus safety valve. This control line flow passage 80 extends parallel to and inside a second longitudinally extending flow passage 102. Flow passage 102 extends between annulus safety valve 6 and landing nipple 4. It can be seen that shuttle valve 76 which extends across flow port 72 in FIG. 1 and has a sealing seat 75 prevents flow from the annulus though flow port 72 and into longitudinal flow passage 102, unless sufficient pressure is exerted on shuttle valve 76 to open the valve by compressing it against the action of spring 84. Note that a small diameter bypass flow port 74 does extend through shuttle valve 76 to permit equalization of pressure across the shuttle valve, as well as flow from flow passage 102 up through flow port 72.

The annulus safety valve 6 is positioned on the interior of landing nipple 4 and the control line operated valve member is positioned between flow passage 102 and flow passage 110. The valve is actuated by control fluid passing through control port 70 and through longitudinal control line passage 80. Control fluid pressure in passage 80 acts through annulus safety valve control line port 86 to pressurize control fluid chamber 77. This control fluid chamber is flanked by a stationary inner mandrel 89 having O-ring seals 90 and 92 on opposite sides and a movable piston 88. Piston 88 is subjected to forces from the control fluid pressure in chamber 77 and from spring 91 which is trapped between the piston 88 and mandrel 89.

The seal for the annulus safety valve is accomplished by a contact between an elastomeric seal 96 and an opposed nose or projection 98 on an elongated seal ring 108. Seal 96 is contained within a cavity at the extreme lower end of piston 88 and as control fluid pressure is exerted in pressure chamber 77, valve 88 moves up against the action of spring 91 and away from seal ring 108. As piston 88 moves up, the seal moves away from nose 98 on seal ring 108 to permit flow between longitudinal flow passage 102 and flow passage 110. The valve 6 is therefore opened to permit injection of treating fluids without subjecting the seal 96 to significant adverse flow characteristics. The forces acting on conventional seals during opening of conventional valves are a serious factor leading to the deterioration of conventional seals. This flow of injected material in the annulus can then continue to flow through passage 110 and out ports 126. Note that seal ring 108 has a seal 120 contacting inner seal bore on hanger 4 immediately below control line port 116 in the landing nipple, thus preventing any leakage of flow from longitudinal flow passage 102 into the space between the annulus safety valve and the hanger 8 immediately below port 126. The fluid injected into the annulus can then continue to flow between the annulus safety valve and the hanger until reaching ports 154, at which point the flow can then return to the annulus below the packoff hanger. Note, the lower flow port 154 will be opened when annulus safety valve 6 is inserted on the interior of nipple 4. The lower packing sub 158 on safety valve 6 abuts sliding sleeve 10 adjacent port 154 on hanger 8, and moves the sliding sleeve down to open this port.

The assembly of FIG. 1 permits the injection of fluids, including gas, through the tubing-casing annulus to a production zone below the tubing assembly while incorporating the appropriate safety valves for closing the tubing and the annulus during an emergency. There are two valves which permit injection of fluid through the annulus. Shuttle valve 76 provides a means of controlling communication from the annulus beneath the packoff device 138 into the annulus above, while allowing a large fluid area for injection from the annulus above to the annulus below. It does this by means of the spring 84 which keeps the face-to-face metal seat 75 in place and the O-ring seal 78 which spans the port. The small equalization port 74 extends through that shuttle piston 76. Now when the valve is closed the pressure below tries to vent into the annulus above, this small port will meter that flow. Also, the differential effect will bias the piston in the upward direction.

Although FIG. 1 shows the position of the principal components of this tubing and annulus safety valve assembly, FIG. 1 should be viewed in conjunction with FIG. 7 which demonstrates the manner in which hanger 8 is set prior to insertion of tubing safety valve 2 and annulus safety valve 6. The hanger 8 and nipple 4 are run in on the production string substantially in the configuration shown in FIG. 7. In this configuration, nipple 14, flow coupling 38, nipple 4, and hanger 8, are all incorporated into the tubing string T in the proper sequence and the tubing string is lowered into the well. Tubing safety valve control line 16 and annulus safety valve control line 50 are positioned on the exterior of the production tubing T and are fixed to their corresponding control line connections. Control line port 29 is sealed by means of a sealing sleeve 164 attached to nipple 14 by means of a conventional lock 160. Seals 166 and 168 engage inner seal bores flanking port 29 to close the port. Separation sleeve 178 is attached on the interior of landing nipple 4 again by means of a conventional lock 170 and a dog or lug member 172 engaging locking recess 54. Seals 174 and 176 on separation sleeve 178 engage landing nipple 4 above and below control line port 70. Separation sleeve 178 comprises an inner mandrel 182 extending parallel to an outer mandrel 180 to define a longitudinal flow passage 184 therebetween. Port 70 in nipple 4 communicates through the inner mandrel 180 to control fluid passage 184. This control fluid passage in turn communicates with landing nipple control fluid port 116 at the lower end of the landing nipple. Seals 185 and 186 flank port 116 and permit control fluid to be injected through control line tubing 50 to port 118 on hanger 8. This communication provides control line pressure generation in hanger pressure chamber 124 which, upon expansion, will cause hanger 8 to be packed-off and set in engagement with casing C. As control fluid pressure is applied in chamber 124, movable piston 114 is urged downwardly and it will act upon packing element mandrel 138. This force will be transmitted to upper expansion cone housing 144. Although not shown in FIG. 7, lower expansion cone housing 152 is not free to move longitudinally. Therefore, upper housing cone 144 will move toward 152 under the action of control fluid pressure to force upper and lower slips 146 and 150 radially outward into engagement with casing C. Note that in FIG. 7 the upper and lower slips 146 are both shown in this schematic rendition. It should be noted that comparison of FIG. 7 with FIG. 1 will reveal substantial differences in the slip and cone assembly of hanger 8. As previously mentioned, however, the detailed construction of the hanger shown in FIG. 7 shows the slip assembly more accurately. After the hanger has been set in the manner depicted in FIG. 7, sealing sleeve 164 and separation sleeve 178 may be removed to make room for tubing safety valve 2 and annulus safety valve 6. Both these valves may be inserted by conventional wireline techniques.

RETRIEVAL

Figure 5A:
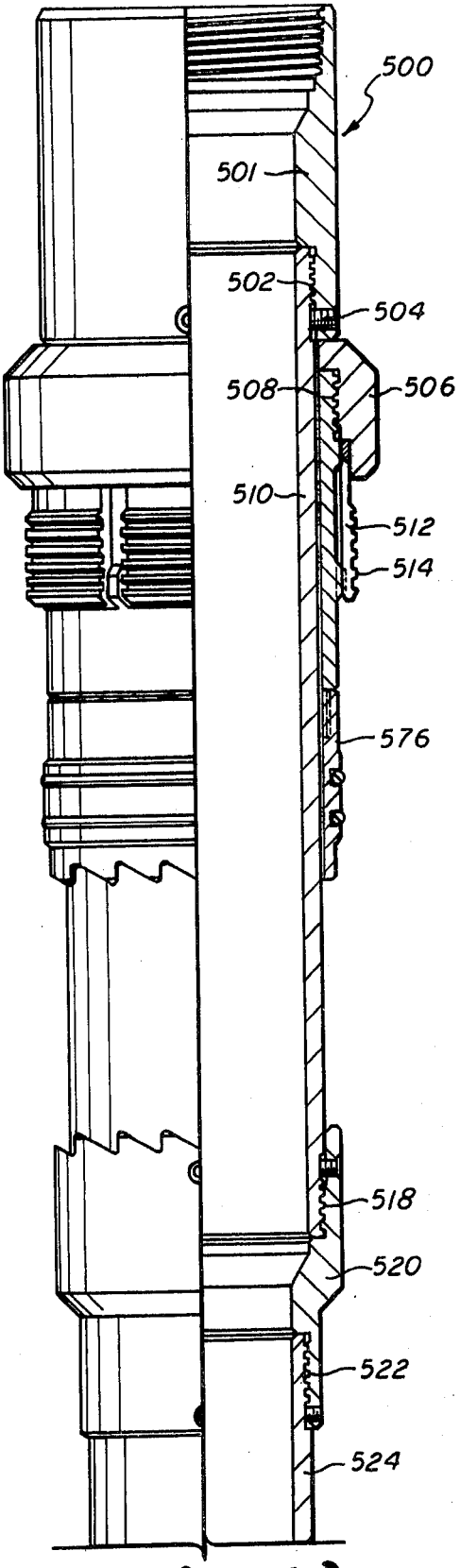
FIG. 5 comprises a series of two continuations, FIGS. 5A and 5B, showing a retrieving tool for use in disengaging the hanger shown in FIG. 4.
Figure 5B:
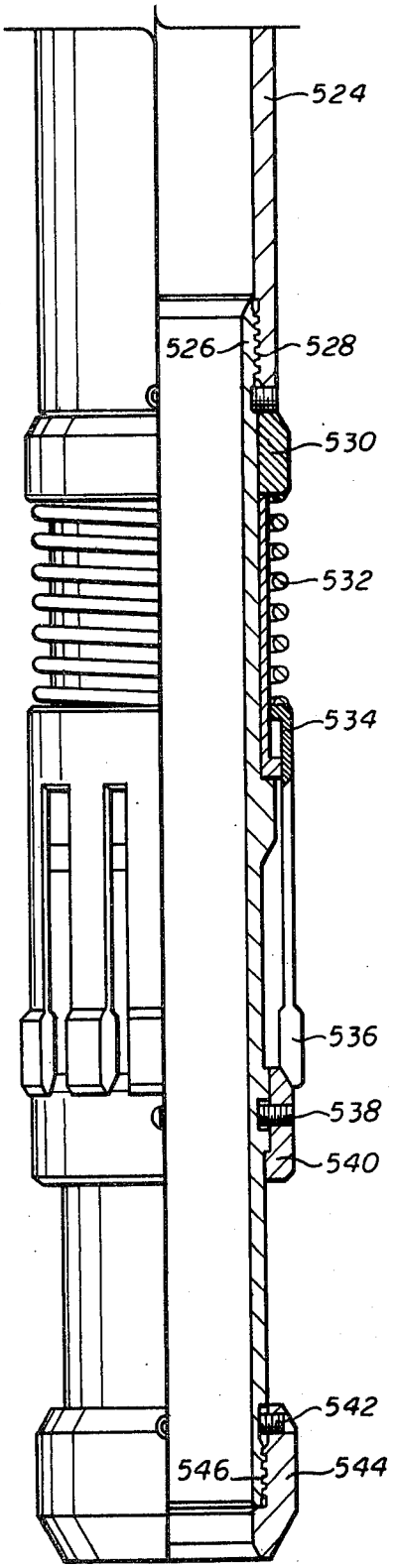
Figure 8:
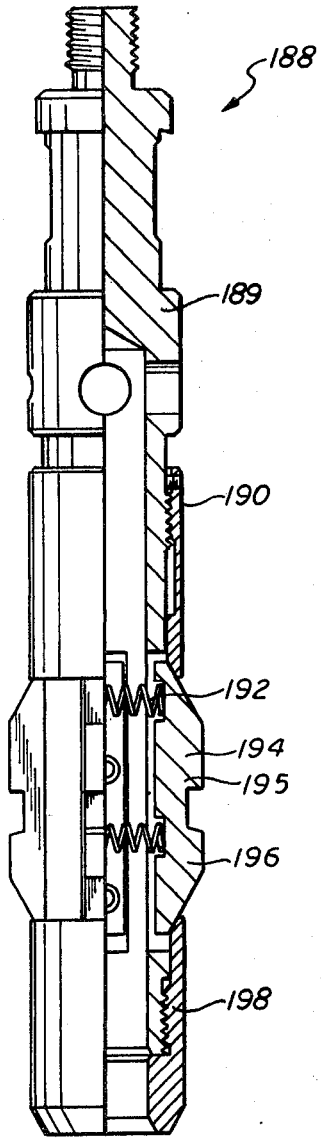
FIG. 8 shows the wireline equalizing tool used in conjunction with the annulus safety valve shown in FIG. 3.

Removal of the hanger valve assembly can be accomplished with the use of tools shown in FIG. 8 and in FIG. 5. Removal of annulus safety valve 6 would generally require equalization of the annulus tubing pressure differential existing across the valve. Equalization may be accomplished by inserting equalizing tool 188 by appropriate wireline techniques. This equalizing tool comprises a mandrel 189 and a key member 194 urged outwardly by springs 192. Key 194 has a unique profile having upper and lower outwardly extending dogs 195 and 196 which prevent engagement with any profile which may be encountered on the interior of the tubing string except the profile on the interior of equalizing sleeve 136. This profile is shown more clearly in FIG. 3 where two adjacent grooves 384 and 386 are shown at the lower end of the equalizing sleeve. When key 194 engages these grooves, downward jarring will move equalizing sleeve 136 downward to open equalizing port 134 in FIG. 1. Thus, the pressure differential existing between the tubing and the annulus across the annulus safety valve will be equalized. The annulus safety valve can then be removed by conventional wireline techniques. The next step in the removal of this assembly would be disengagement of latch 94 engaging threads 100 on hanger 8. Rotation of the tubing string above the hanger, and subsequent rotation of the landing nipple 4 will result in the release of landing nipple 4 from hanger 8 after which the tubing above hanger 8 may be removed from the well. A retrieval tool, shown in FIG. 5, can now be inserted into the well to release hanger 8 from casing C. The hanger can be retrieved by using a retrieval tool 500, shown in FIG. 5. Retrieving tool 500 comprises a top sub 501 connected to an upper body 510 by means of threaded connection 502. A set screw 504 prevents disengagement of this threaded connection. A top collar 506 is positioned on the exterior of upper body 510 and retains a latch 512 on the exterior of upper body 510. Latch 512 contains square threads 514 on the exterior, which can be used to engage the square threads 400 at the upper end of hanger 8. Upper body 510 is connected to a space-out coupling by means of a connector sub 520 with threaded connections 518 and 522 at the upper and lower end, respectively. Space-out coupling 524 is necessary in order to provide proper spacing between latch 512 and the disengaging means located at the lower end of space-out member 524. Lower body 526 is attached to the lower end of space-out coupling 524 again by means of a conventional threaded connection 528. A spring stop 530 extends around the exterior of lower body 526 and abuts spring 532 at its upper end. Spring 532 in turn engages a catch sleeve 536 at its upper end 534. The lower portion of catch sleeve 536 is positioned against a ring retainer 540 which together with spring 532 urges catch sleeve 536 radially outward. Shear ring retainer 540 is held in position by means of a screw 538 having a predetermined shear value. A bottom sub 544 is in turn connected to the lower end of lower body 526 by means of threaded connection 546 and set screw 542. Insertion of retrieving tool 500 into the tubing hanger will result in engagement between latch 512 and threads 400 at the upper end of hanger 8. After engagement between these threads an upstrain on retrieving tool 500 will cause latch 536 to engage release sleeve 480 on hanger 8, as shown in FIG. 4. Release sleeve or shiftable retaining member 480 can then be moved upwardly after shear screw 490 is severed. Upward movement of shiftable member 480 will result in relative movement between the stepped surfaces of retaining member 480 and segments 482. When the stepped inner surface of segment 486 has passed the stepped portion of 488 of shiftable retaining member 480, the segment may move radially inward, thus releasing threaded engagement between the segments and retaining sleeve 472. Release of these threads will in turn allow collapse of the lower expander member 468 on the exterior of hanger 8. Slips 462 and packing elements 432 will then be free to move radially inward, thus releasing the hanger from the casing and allowing retrieval of the hanger and the tubing extending therebelow.

If for some reason shiftable retaining member 480 cannot be moved by retrieving tool 500, the retrieving tool can be released by applying a slight amount of strain in rotating the tubing and retrieving tool. After rotating the tubing for a sufficient number of turns, the latch threads 514 will unscrew from the threads on the top of hanger 8. The retrieving tool can then be pulled from the well.

Although the invention has been described in terms of the specified embodiment, which is set forth in detail, it should be understood that this is by illustration only and that the invention is not necessarily limited thereto since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. In an apparatus for use in a subterranean well comprising a hanger for supporting an interior conduit such as a tubing string extending therebelow, said hanger being anchorable against an exterior conduit, upon radial expansion of anchoring slip elements in response to fluid pressure in a pressure chamber communicating through a hanger port extending to the interior bore of said hanger, with fluid pressure acting upon a hydraulically activated hanger slip setting piston and an annulus safety valve for controlling fluid flow in the annulus between said interior and exterior conduits in response to fluid pressure in a separate control line, the improvement comprising control line communication means for activating said hydraulically activated hanger slip setting piston and said safety valve by means of fluid pressure in the same control line, said control line communication means comprising:

landing nipple means for engaging said hanger and the interior conduit extending above said hanger, a first radially extending port in said landing nipple means communicable with said control line and said annulus safety valve;

a second radially extending port in said landing nipple means communicable with said hanger port;

disengageable means for suspending said annulus safety valve from said landing nipple means; and separation sleeve means suspendable from said landing nipple means instead of said annulus safety valve for establishing fluid communication between said first and second radially extending ports to expose said hydraulically activated hanger slip setting piston to fluid pressure in said separate control line to set said hanger prior to installation of said annulus safety valve.

2. The apparatus of claim 1 further comprising a polished bore surface on the interior of said landing nipple means above and below said first radially extending port for alternatively contacting seal members on said sleeve member and said valve member.

3. The apparatus of claim 2 further comprising sealing means on the exterior of said landing nipple means on opposite sides of said second radially extending port for establishing sealing integrity with said interior bore of said hanger above and below said hanger port.

4. The apparatus of claim 3 further comprising latching means on said landing nipple means for engaging said hanger.

5. The apparatus of claim 4 further comprising means for engaging the interior conduit extending above said landing nipple means to incorporate said landing nipple at the base of the interior conduit extending above the hanger.

6. The apparatus of claim 1 wherein said annulus safety valve is suspendable from the interior of said landing nipple means.

7. The apparatus of claim 6 wherein said landing nipple means further comprises a radial flow port between said first and second radially extending ports.

8. The apparatus of claim 7 wherein said landing nipple means further comprises a second valve regulating flow through said flow port.

9. The apparatus of claim 1 wherein said hanger further comprises annular packing elements for establishing sealing integrity in the annular area between the interior conduit and the exterior conduit.

10. In an apparatus for use in a subterranean well comprising a hanger for supporting an interior conduit extending therebelow, said hanger being anchorable against an exterior conduit, upon radial expansion of anchoring slip elements in response to fluid pressure in a pressure chamber communicating through a hanger port extending to the interior bore of said hanger, with the fluid pressure acting upon a hydraulically activated hanger slip setting piston, the improvement comprising a landing nipple comprising:

means for connection with a fluid control line extending along the exterior of said interior conduit;

a first radially extending port communicating with said means for connection with a fluid control line;

a second radially extending port longitudinally spaced from said first radially extending port;

means for alternatively suspending a sleeve member and a valve member along the interior of landing nipple and for establishing fluid communication between said means for connection with a fluid control line and a flow passage in said sleeve member to said hanger pressure chamber and alternatively for establishing fluid communication between said means for connection with a fluid control line and a fluid pressure activated valve in said valve member.

11. The apparatus of claim 10 further comprising a polished bore surface on the interior of said landing nipple above and below said first radially extending port for alternatively contacting seal members on said sleeve member and said valve member.

12. The apparatus of claim 10 further comprising sealing means on the exterior of said landing nipple on opposite sides of said second radially extending port for establishing sealing integrity with said interior bore of said hanger above and below said hanger port.

13. The apparatus of claim 12 further comprising latching means on said landing nipple for engaging said hanger.

14. The apparatus of claim 13 further comprising means for engaging the interior conduit extending above said landing nipple to incorporate said landing nipple at the base of the interior conduit extending above the hanger.

* * * * *